United States Patent [19]

Bernstein

[11] 4,158,530

[45] Jun. 19, 1979

[54] PUMPING APPARATUS COMPRISING TWO COLLAPSIBLE CHAMBERS

[76] Inventor: Robert E. Bernstein, 8 Merriam Rd., Framingham, Mass. 01701

[21] Appl. No.: 673,837

[22] Filed: Apr. 5, 1976

Related U.S. Application Data

[63] Continuation of Ser. No. 484,940, Jul. 1, 1974, abandoned.

[51] Int. Cl.[2] ..... F04B 43/10; F04B 45/06

[52] U.S. Cl. ..... 417/389; 417/394; 417/486

[58] Field of Search ..... 417/394, 395, 389, 474, 417/478, 479, 480, 475, 486, 507; 251/5

[56] References Cited

U.S. PATENT DOCUMENTS

| | | | |
|---|---|---|---|
| 2,291,912 | 8/1942 | Meyers | 417/474 |
| 2,760,436 | 8/1956 | Von Seggern | 251/5 |
| 3,143,124 | 8/1964 | Todd | 251/5 |
| 3,154,021 | 10/1964 | Vick | 417/394 |
| 3,175,498 | 3/1965 | Rohrer | 417/474 |
| 3,314,371 | 4/1967 | Hopkinson | 417/474 |
| 3,417,707 | 12/1968 | Zimmer | 417/475 |
| 3,701,618 | 10/1972 | Wall et al. | 417/474 |

FOREIGN PATENT DOCUMENTS

| | | | |
|---|---|---|---|
| 977799 | 4/1951 | France | 417/486 |

*Primary Examiner*—Carlton R. Croyle
*Assistant Examiner*—Thomas I. Ross
*Attorney, Agent, or Firm*—Lawrence S. Cohen

[57] ABSTRACT

A pump having two collapsible pumping chambers connected in series is coupled to a pump drive mechanism which opens and closes each chamber in a sequence that produces pumping action.

14 Claims, 5 Drawing Figures

PUMPING APPARATUS COMPRISING TWO COLLAPSIBLE CHAMBERS

This is a continuation of application Ser. No. 484,940 filed July 1, 1974, now abandoned.

BACKGROUND OF THE INVENTION

1. Field of the Invention

This invention relates to pumps. More particularly, this invention relates to pumps having one or more collapsible pumping chambers.

2. Description of Prior Art

In U.S. Pat. No. 3,154,021, there is disclosed a pump having three collapsible pumping chambers connected in series. Pumping action is produced by opening, closing or partly closing the three chambers in a particular sequence. In U.S. Pat. No. 2,291,912, U.S. Pat. No. 3,048,121, U.S. Pat. No. 3,148,624 and U.S. Pat. No. 3,175,498, other pumps having one or more collapsible pumping chambers are disclosed, and in U.S. Pat. No. 3,701,618 there is disclosed an extrusion press having collapsible pumping chambers which open and close so as to force extrusion material through a die.

SUMMARY OF THE INVENTION

It is an object of this invention to provide a new and improved pump apparatus.

It is another object of this invention to provide a new and improved collapsible chamber pump.

It is still another object of this invention to provide a technique for producing pumping action utilizing two collapsible pumping chambers coupled in series.

It is yet another object of this invention to provide a pump apparatus that is easy to construct, has relatively few parts, is easy to repair and is not easily damaged.

It is another object of this invention to provide a pump that is self-priming, that does not require any check valves or rotary seals, that can be used for metering, transferring, dispensing, circulating and most any process pumping operation and that is especially useful in pumping corrosive liquids, liquids containing solids and solvents.

The above and other objects are achieved by providing a pump apparatus comprising a pump having two collapsible pumping chambers connected in series and a pump drive mechanism which opens and closes the two chambers in a three-step cycle that produces pumping action. Before the pumping cycle is started, both chambers are caused to close. In the first step of the pumping cycle, the chamber at the inlet end of the pump is opened while the chamber at the outlet end of the pump remains closed. In the second step in the pumping cycle, the chamber at the inlet end of the pump is closed and the chamber at the outlet end of the pump is opened. In the third or last step in the pumping cycle, the chamber at the outlet end of the pump is closed while the chamber at the inlet end of the pump remains closed. The cycle is then repeated. A pulsating type of pumping action is thus produced.

BRIEF DESCRIPTION OF THE DRAWINGS

A more complete appreciation of the invention and many of the attendant advantages thereof will be readily appreciated as the same becomes better understood by reference to the following detailed description when considered in connection with the accompanying drawings wherein like reference numerals represent like parts and wherein.

DESCRIPTION OF PREFERRED EMBODIMENTS

Figures 1, 2, 3, 4, 5:
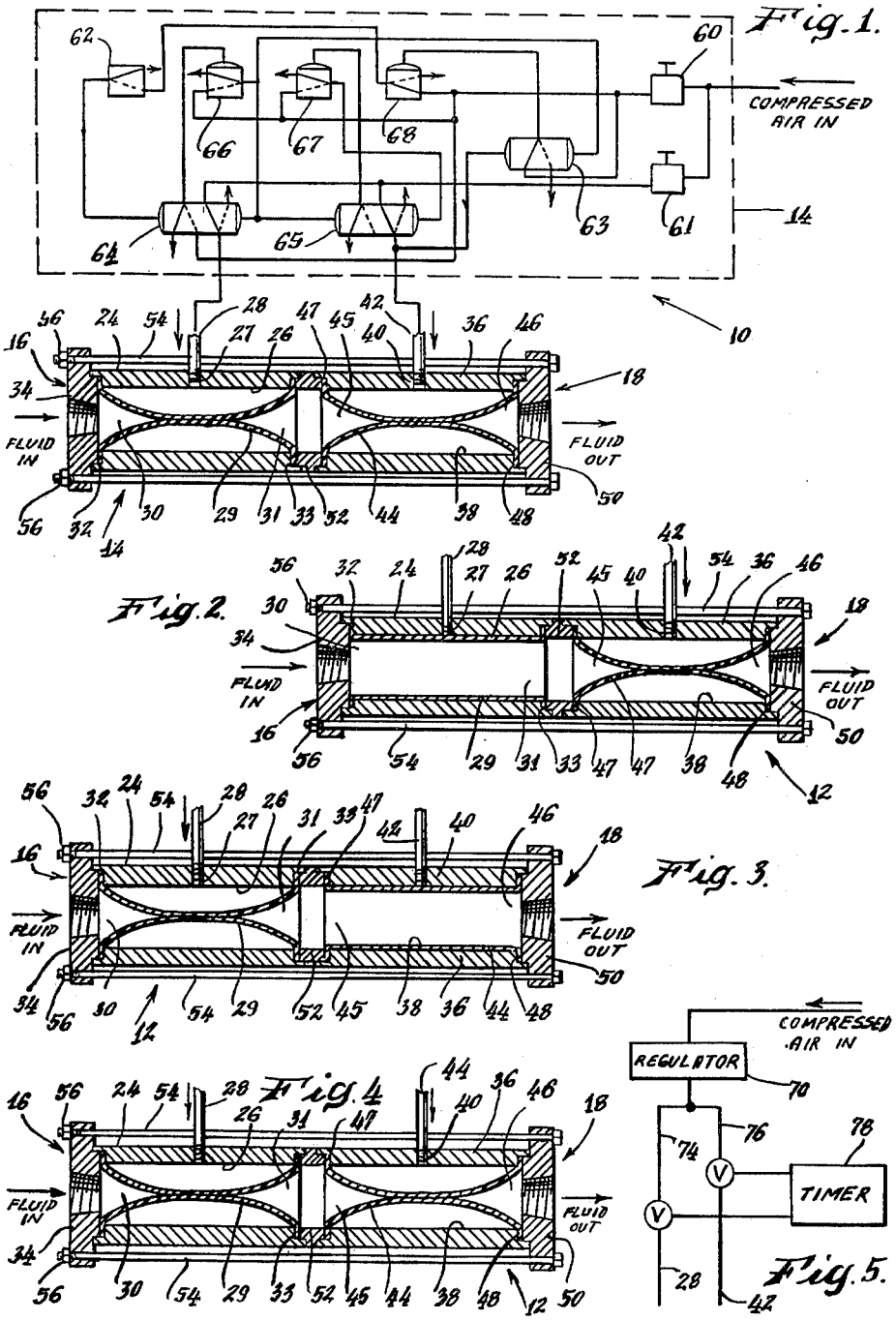
FIG. 1 is a view partly in section and partly in schematic of a pump apparatus in accordance with this invention, with the pump being shown before the start of the pumping cycle.
FIGS. 2, 3 and 4 are section views of the pump portion of the apparatus at successive steps in the pumping cycle.
FIG. 5 is a schematic view of an alternate embodiment of the pump drive mechanism portion of the invention.

Referring to the drawings there is shown a pumping apparatus indicated in general by the reference numeral 10. The pumping apparatus includes a pump 12 which is coupled to a pump drive mechanism 14.

The pump 12 includes an inlet section 16 and an outlet section 18. Inlet section 16 includes an elongated cylindrical body 24 of rigid material having an axial cylindrical bore 26 extending longitudinally therethrough and a counterbore at each end. Cylindrical body 24 is provided with an aperture 27 extending downward from the outer surface to the bore 26 for supplying air (or other gas) under pressure to the bore 26 through a conduit 28 connected to the pump drive mechanism 14. A collapsible tubular shaped chamber 29 of elastomeric material having inlet and outlet ends 30 and 31 respectively is concentrically positioned within the cylindrical body 24 extending longitudinally throughout the length of the bore 26 in close fitting relationship. The chamber 29 includes integrally formed outwardly projecting annular flanges 32 and 33 which extend outward beyond the ends of the cylindrical body 24. The inlet section 16 further includes an annular shaped end cap 34 of rigid material that is internally threaded so that it may be connected to a source of fluid (not shown) which is to be pumped and includes a boss projecting axially outward from its inner side.

Outlet section 18 is of similar construction as inlet section 16 and thus includes a cylindrical body 36 of rigid material having an axial cylindrical bore 38, a counterbore at each end, and a downwardly extending aperture 40 for supplying air under pressure to the bore 38 through a conduit 42 connected to the pump drive mechanism 14, a collapsible tubular chamber 44 of elastomeric material having inlet and outlet ends 45 and 46 on which are formed annular flanges 47 and 48 and an end cap 50 having a boss projecting axially outward from its inner side through which the pumped fluid is expelled that is threaded on its inner surface.

An annular shaped body of rigid material having bosses projecting axially outward from each side is positioned between annular flanges 33 and 47 to form an end cap 52 that is common to both the inlet section 16 and the outlet section 18. The inlet and outlet sections are held together by bolts 54 which extend through the end caps 48 and 50 and which are secured by nuts 56. When the inlet and outlet sections are assembled as shown in the drawings, air tight compartments for receiving air through apertures 27 and 40 are formed in the annular spaces between each cylindrical body and the tubular chamber positioned within the cylindrical body.

The pump drive mechanism 14 includes a pair of pressure regulators 60 and 61 which receive compressed air from a suitable source (not shown), a switch operated three port valve 62, a three-port pilot-operated spool valve 63, a pair of six-port pilot-operated spool valves 64 and 65 and three pneumatic time delay valves 66, 67 and 68. Pressure regulator 61 controls the pressure of the air supplied to the annular spaces between the cylindrical bodies and the tubular chambers through conduits 27 and 42, and pressure regulator 60 controls the pressure of the air supplied to the timing circuit portion of the pump drive mechanism. When the switch operated three-port valve 62 is in the "off" position, compressed air passes through apertures 27 and 40 to bores 26 and 38 respectively at sufficient pressures to cause chambers 29 and 44 to collapse inwardly and close (see FIG. 1). When the switch operated three-port valve 62 is placed in the "on" position, the timing circuit is activated and the pumping cycle begins. First, the pressure applied to chamber 29 is released causing that chamber to return to its open (i.e., uncompressed) condition and be filled with the fluid being pumped (see FIG. 2). Then air is again applied through aperture 27 at sufficient pressure to close chamber 29, pushing fluid from chamber 29 toward chamber 44 (see FIG. 3). At the same time, the pressure applied to chamber 44 is released causing chamber 44 to return to its open condition and receive the fluid that is being transferred from chamber 29. Transfer of fluid from the chamber 29 to the chamber 44 is aided by the fact that opening of the chamber 44 causes a vacuum to be formed in chamber 44, thereby sucking fluid from the chamber 29 to chamber 44. Finally, fluid is discharged from the pump 12 by supplying air through aperture 40 at a sufficient pressure to close chamber 44 while chamber 27 remains closed (see FIG. 4). Closing chamber 44 also serves to close off the pump 12 to the head just created by it. The cycle is repeated by releasing the pressure applied to chamber 29 through aperture 27.

The amount of fluid discharged by the pump 12 during one cycle is dependent on the pressure in the discharge line. When the chamber 29 is fully closed and the chamber 44 is opened (see FIG. 3) the outlet section 18 is partly filled with fluid being transferred from the inlet section 16 and partly by fluid already discharged. The actual volume of fluid transferred by the pump 12 during a pumping cycle thus decreases as the discharge pressure is increased.

The pump flow rate can be regulated by varying the number of cycles per unit time or by varying the volume pumped per cycle.

The cycles per unit time can be varied by changing the settings in the time delay valves or by varying the air pressure to the time delay valves. Volume pumped per cycle can be varied by using different size chambers. The effective size of the chambers can also be altered by allowing the air that goes into the bores to be controlled by flow control valves which allow air to go into the bores normally but vary the time it takes for the air to leave the bores.

In the embodiment described above the cylindrical body and the end caps are made of aluminum and the elastomeric chambers are cylindrically shaped and made of rubber. Other suitable materials that can be used for the cylindrical body and end caps include steel, nickel and plastic materials such as polycarbonates, pvc, polytetrafluoroethylene or other polymers. Other suitable materials that can be used for the elastomeric chamber include butyl, silicone and neoprene. Other suitable shapes for the elastomeric chambers include spherical and hemispherical.

In an alternate pump construction, a length of elastomeric tubing extends through both pump chambers and is connected at the inlet end to the source of fluid being pumped and at the outlet end to the device for receiving the fluid being pumped. In this way, the fluid passing through the pump does not come into direct contact with the inner walls of the pumping chambers.

A pump apparatus has been constructed according to this invention wherein the chambers were tubular and made of natural rubber with an inside diameter of about 0.36 inches, the air pressure to the outside of the chamber and timing circuit was 40 psig, the flow rate of the water being pumped was 200 cc. per minute, the water source was three feet below the centerline of the pump and the receptacle receiving the pumped water was 12 feet above the centerline of the pump. The pump drive mechanism was set up so that the time taken for one complete pump cycle was in the order of one-half a second.

FIG. 5 illustrates another embodiment of the pump drive mechanism wherein compressed air is supplied to the conduits 28 and 42 through an adjustable pressure reducing valve 70 which is coupled to electrical operative solenoid valves 74 and 76, respectively, which are both electrically connected to a multicam electric timer 78 to provide for the predetermined timed cyclic opening and closing of these valves in accordance with the desired pumping sequence. Valves 74 and 76 are three way solenoid valves which permit venting of the chambers to the atmosphere through the valves.

The pump constructed according to this invention can operate with pump drive pressures as low as 25 psig. It should also be noted that several pumps constructed according to this invention could, if desired, be connected in parallel to one pump drive mechanism. Operating the pump dry will not damage the pump, and closing off the discharge completely while the pump is operating will not damage the pump.

Another advantage of the pump is that there is independent control of pulse pressure applied to the outside of the chambers. This feature gives the fluid being pumped a regulated pulsating flow which makes the pump especially suited for use as a blood pump for use in heart surgery. Another advantage of the pump is that the chambers, since they are made of elastomeric material, will close even if there are solids in the line. This makes the pump especially useful in pumping liquids containing solids.

What is claimed is:

1. Pumping apparatus comprising:

a valvelessly operable pump having only two pumping sections, an inlet section for receiving fluid to be pumped and an outlet section for discharging fluid from the pump, a collapsible chamber disposed within each section, each chamber having an inlet and an outlet end, the outlet end of the chamber in the inlet section being operatively directly connected in series to the inlet end of the chamber in the outlet section so that fluid in the chamber in the inlet section discharges into the chamber in the outlet section, and a pump drive mechanism coupled to the pump for sequentially opening and closing the pump chambers in a manner so as to produce pumping action.

2. Pumping apparatus according to claim 1 and wherein the collapsible chamber in each section is comprised of elastomeric material.

3. Pumping apparatus according to claim 2 wherein the collapsible chamber in each section is an elongated tubular member.

4. Pumping apparatus according to claim 3 and wherein each section includes an elongated cylindrical member of rigid material and wherein said chambers are positioned within the respective members.

5. Pumping apparatus according to claim 4 and wherein the pump drive mechanism includes means for alternately applying and releasing external pressure to each chamber so as to produce a sequential opening and closing of the chambers.

6. The pumping apparatus of claim 1 wherein the pump drive mechanism includes means for fluid pressurizing each section to collapse the chamber therein and for reducing the fluid pressure in each section to permit the chamber to open, and means for causing each chamber to open when the fluid pressure is reduced.

7. The pumping apparatus of claim 6 wherein each chamber comprises elastomeric material and is open in an unstressed state so that upon reducing pressure in respective sections the chamber therein is caused to open.

8. Pumping apparatus comprising:

a pump having only two pumping sections, an inlet section for receiving fluid to be pumped and an outlet section for discharging fluid from the pump, a collapsible chamber disposed within each section, each chamber having an inlet and an outlet end, the outlet end of the chamber in the inlet section being operatively directly connected in series to the inlet end of the chamber in the outlet section so that fluid in the chamber in the inlet section discharges into the chamber in the outlet section, and a pump drive mechanism coupled to the pump for sequentially opening and closing the pump chambers in a manner so as to produce pumping action, wherein the pump drive mechanism includes means to produce the following sequence of actions:

Step (1) opening the chamber in the inlet section to receive fluid to be pumped from an external source connected directly to it while maintaining the chamber in the outlet section closed, Step (2) closing the chamber in the inlet section and simultaneously opening the chamber in the outlet section thereby causing fluid contained in the inlet section to flow out of the chamber therein and to be received in the chamber in the outlet section, Step (3) closing the chamber in the outlet section while maintaining the chamber in the inlet section closed to cause fluid contained in the chamber in the outlet section to be discharged from the pumping apparatus.

9. A three step pumping process for employment with a pumping apparatus limited to two pumping sections, an inlet section and an outlet section, each section having relatively rigid walls and each section having a flexible walled collapsible chamber therein means for opening each chamber and a pump drive mechanism for cycling and control of the pumping apparatus according to a cyclical order comprising:

STEP 1 opening the chamber in the inlet section to receive fluid to be pumped from an external source connected directly to it while maintaining the chamber in the outlet section closed, STEP 2 closing the chamber in the inlet section and simultaneously opening the chamber in the outlet section thereby causing fluid contained in the inlet section to flow out of the chamber therein and to be received in the chamber in the outlet section, STEP 3 closing the chamber in the outlet section while maintaining the chamber in the inlet section closed to cause fluid contained in the chamber in the outlet section to be discharged from the pumping apparatus.

10. The process of claim 9 further comprising continuously repeating the foregoing steps to achieve continuous pumping action.

11. The process of claim 9 wherein a fluid pump drive mechanism is employed and the STEPS of the process are achieved by closing the chambers by fluid pressurizing the respective sections, by maintaining the chambers closed by maintaining fluid pressurizing in the respective sections and by opening the chambers by reducing the fluid pressure to a desired level in the respective sections.

12. The process of claim 11 wherein the process is employed with a pumping apparatus in which the collapsible chambers are made of an elastomeric material and are open in an unstressed state, further comprising opening the chambers by reducing the fluid pressure by opening each section to the ambient environment during the step of releasing applied fluid pressure.

13. A pumping process for employment with a two section pumping apparatus limited to two pumping sections, an inlet section and an outlet section each section having relatively rigid walls and a collapsible chamber in each section, and a pump drive mechanism for fluid cycling and control of the pumping apparatus by pressurizing each section to collapse the chamber therein, and reducing such pressure to permit expansion of the chamber, and including means for causing the chamber to open, according to a cyclical order comprising:

STEP 1 releasing applied fluid pressure in the inlet section permitting the collapsible chamber to open and causing said chamber to open to receive fluid to be pumped from an external source connected to it while simultaneously maintaining applied fluid pressure in the outlet section to maintain the collapsible chamber therein collapsed, STEP 2 then applying fluid pressure to the inlet section of the pumping apparatus sufficient to collapse the collapsible chamber when containing fluid to be pumped causing fluid to flow out of the chamber and simultaneously releasing applied fluid pressure in the outlet section of the pumping apparatus permitting the collapsible chamber to open and causing said chamber to open to receive fluid flowing from the inlet chamber, STEP 3 then applying fluid pressure to the outlet section sufficient to collapse the collapsible chamber and causing fluid contained therein to be discharged from the pumping apparatus, continuously repeating the foregoing steps to achieve pumping action.

14. The process of claim 13 in which the collapsible chambers of the pumping apparatus are made of an elastomeric material and are open, in the unstressed state, wherein the chambers are permitted to open by releasing pressure in the respective sections by opening each section to the ambient environment during the step or releasing applied fluid pressure, thereby causing the chamber to be restored to its open unstressed configuration.

* * * * *